US007517067B2

(12) United States Patent
Inoue et al.

(10) Patent No.: US 7,517,067 B2
(45) Date of Patent: Apr. 14, 2009

(54) INK SUPPLY SYSTEM, RECORDING APPARATUS, RECORDING HEAD, AND LIQUID SUPPLY SYSTEM

(75) Inventors: Ryoji Inoue, Kanagawa (JP); Hideki Ogura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 358 days.

(21) Appl. No.: 11/504,603

(22) Filed: Aug. 16, 2006

(65) Prior Publication Data

US 2006/0274133 A1 Dec. 7, 2006

Related U.S. Application Data

(62) Division of application No. 10/940,673, filed on Sep. 15, 2004, now Pat. No. 7,128,407.

(30) Foreign Application Priority Data

Sep. 29, 2003 (JP) ..... 2003-338726

(51) Int. Cl.
*B41J 2/175* (2006.01)
*B41J 2/19* (2006.01)

(52) U.S. Cl. ..... 347/85; 347/92

(58) Field of Classification Search ..... 347/85, 347/86, 87, 92, 93; 141/2, 18
See application file for complete search history.

(56) References Cited

U.S. PATENT DOCUMENTS 5,351,073 A * 9/1994 Kageyama et al. ..... 347/87
5,457,485 A * 10/1995 Moriyama et al. ..... 347/92
5,905,518 A 5/1999 DeFilippis ..... 347/85
6,000,789 A 12/1999 Takagi et al. ..... 347/86
6,022,102 A 2/2000 Ikkatai et al. ..... 347/85
6,158,855 A 12/2000 Saikawa ..... 347/93
6,296,352 B1 * 10/2001 Hollands et al. ..... 347/86
6,347,863 B1 2/2002 Yuen ..... 347/85
6,460,984 B1 10/2002 Matsumoto et al. ..... 347/86
6,520,630 B1 2/2003 Oda et al. ..... 347/85
6,685,296 B2 2/2004 Mochizuki et al. ..... 347/19
6,702,433 B2 3/2004 Kono ..... 347/85
6,719,394 B2 4/2004 Kubota et al. ..... 347/19
6,773,099 B2 8/2004 Inoue et al. ..... 347/86
6,799,841 B2 10/2004 Iri et al. ..... 347/85
6,799,844 B2 * 10/2004 Leighton et al. ..... 347/86

(Continued)

FOREIGN PATENT DOCUMENTS

JP 2003-80714 3/2003

*Primary Examiner*—Anh T. N. Vo
(74) *Attorney, Agent, or Firm*—Fitzpatrick, Cella, Harper & Scinto

(57) ABSTRACT

An ink supply system comprises an ink tank which contains ink, and a liquid chamber which is connected to the ink tank through a plurality of communication paths, and supplies ink taken from the ink tank to a recording head, wherein the liquid chamber, except the plurality of communication paths and a connection section to the recording head, forms a substantially sealed space; the liquid chamber is provided with a filter which can partition the inside of the liquid chamber into a first region at the side of the ink tank and a second region at the side of the recording head, and can form a meniscus of ink which is broken by a pressure of gas in the second region.

12 Claims, 7 Drawing Sheets

U.S. PATENT DOCUMENTS

| | | | | |
|---|---|---|---|---|
| 6,854,836 | B2 | 2/2005 | Ishinaga et al. | 347/85 |
| 6,976,753 | B2 | 12/2005 | Kuwabara et al. | 347/86 |
| 7,077,514 | B2 | 7/2006 | Inoue et al. | 347/86 |
| 2002/0033855 | A1 | 3/2002 | Kubota et al. | 347/19 |
| 2003/0035036 | A1 | 2/2003 | Ogura et al. | 347/86 |
| 2003/0067518 | A1 | 4/2003 | Ishinaga et al. | 347/85 |
| 2003/0067520 | A1 | 4/2003 | Inoue et al. | 347/86 |
| 2004/0061748 | A1 | 4/2004 | Kuwabara et al. | 347/85 |
| 2004/0090510 | A1 | 5/2004 | Inoue et al. | 347/104 |
| 2005/0068349 | A1 | 3/2005 | Matsumoto et al. | 347/7 |

* cited by examiner

INK SUPPLY SYSTEM, RECORDING APPARATUS, RECORDING HEAD, AND LIQUID SUPPLY SYSTEM

This application is a division of application Ser. No. 10/940,673, filed Sep. 15, 2004 now U.S. Pat. No. 7,128,407.

BACKGROUND OF THE INVENTION

1. Field of the Invention

The present invention relates to an ink supply system, a recording apparatus, a recording head, and a liquid supply system, by which, for example, a liquid such as ink is stably supplied with no wasted liquid from ink tanks and the like as a liquid storage section to a recording head, a pen, and the like as a liquid use section, and a gas in a liquid chamber between a liquid use section and a liquid storage section is exhausted into the liquid storage section.

2. Related Background Art

As a liquid use apparatus, there has been, for example, an ink jet recording apparatus, which forms an image on a recording medium, by giving liquid ink to the recording medium with an ink jet recording head. Recently, such a recording apparatus has been used in many cases for recording including color recording, because the recording apparatus can make comparatively small noises at recording and form small dots with a high density. As one form of such an ink jet recording apparatus, some of the apparatuses install an ink jet recording head, which is provided with ink tanks in an integrated or a detachable manner, and to which ink is supplied from the ink tanks, and comprise a carriage with which the recording head scans (main scanning) the recording medium in a predetermined direction, and conveyance means which conveys (sub-scanning) the recording medium in the direction perpendicular to the main scanning direction relatively to the recording head. The ink jet recording apparatus performs recording by discharging ink from the recording head during the main scanning process of the recording head. Furthermore, the ink jet recording apparatus installs a recording head, which can discharge a black ink and colored inks (yellow, cyan, magenta, and the like), on the carriage, to perform not only monochrome recording of a text image with the black ink, but also to permit full-color recording by changing discharging rate of each color. It becomes important in such an ink jet recording apparatus to appropriately exhaust a gas such as air, which is mixed into, or exists in an ink supply path, becomes important.

Here, the gas which goes into an ink supply system can be roughly classified into the following four groups according to causes for generation of the gas:

1) a gas going into the system from ink discharge ports of the recording head, or a gas generated along with ink discharge operation;
2) a gas separated from a gas dissolved in ink;
3) a gas which permeates into the system through a material forming the ink supply path from the outside; and
4) a gas which goes into the system when the ink tanks in a cartridge form are exchanged.

Incidentally, ink flow paths formed in the ink jet recording head have a very fine configuration to require ink supplied from the ink tanks to the recording head to be in a clean state without mixed foreign substances such as dust. That is, when the foreign substances such as dust are mixed, there is caused a problem that, especially, the narrow discharge ports in the ink flow paths of the recording head, or sections of liquid flow paths which are directly communicated with the ports are clogged with the foreign substances. Thereby, normal discharge operation of ink cannot be performed, and recovery of functions of the recording head can not be realized in some cases.

Then, it is general in many cases to have a configuration in which filter members which remove foreign substances in ink are arranged in the ink flow paths between ink supply needles, which are plunged into the ink tanks, in the recording head and the recording head, and the filter members prevent the foreign substances from entering the inside of the recording head.

On the other hand, the number of the ink discharge ports has been recently increased in order to achieve higher recording speed, and the employed frequency of a driving signal applied to an element which generates energy by which the ink is discharged has become higher and higher. Thereby, ink consumption per unit time has been remarkably increased, too. Accordingly, it is natural that the amount of ink passing through the filter members is increased. In order to reduce pressure loss of the ink at the filter members, it is effective to arrange filter members with a large area by expanding parts of the ink supply paths. However, as, in this case, a bubble which enters into the ink supply paths easily remains in space at the upstream side of the filter members in the expanded section on the ink supply paths to cause a state in which the bubble can not be discharged, there is a possibility that smooth supply of ink is blocked. Moreover, there is a possibility that the ink is caused not to be discharged, too, because the gas remaining in the ink supply paths becomes very small bubbles, and the bubbles are mixed into the ink which is guided to the discharge ports of the recording head.

Accordingly, it is strongly required to remove the gas remaining in the ink supply paths, and the following methods will be listed for removing the gas:

(1) Method by which a Gas is Removed by Cleaning Operation

One of methods by which a gas is removed is the following method by cleaning operation.

As the ink jet recording head performs recording by discharging the ink, which is liquid, as a droplet from the discharge ports arranged opposing to the recording medium, increase in the ink viscosity, ink solidification, adhesion of dust to the discharge ports, mixing of bubbles into liquid flow paths inside the discharge ports, and the like occur due to evaporation of an ink solvent from the discharge ports, and the discharge ports are clogged, and the like. Accordingly, there is a possibility that poor recording is caused.

Therefore, the ink jet recording apparatus is provided with capping means which covers the discharge ports of the recording head when recording is not operated, or a wiping member which sweeps, as required, the surface (discharge-port forming surface) of the recording head on which the discharge ports are formed. The capping means has not only a capping function by which drying of ink at the discharge ports is prevented when recording is not operated, as described above, but also a function by which clogging of the discharge ports is eliminated. For example, when clogging of the discharge ports is caused, the discharge port forming surface is covered with a cap member of the capping means, and ink is sucked and discharged from the discharge ports by a negative pressure applied in the cap member with a suction pump and the like which is communicated with the inside of the cap member. Thereby, clogging in the discharge ports, which is caused by ink solidification, and defective discharge of ink due to thickened ink or mixed bubbles in the flow path are eliminated.

Thus, forced discharge processing of ink, which is performed as described above in order to eliminate the defective discharge of ink, is called cleaning operation. The cleaning operation is carried out when recording is restarted after the long-time inactive state of the recording apparatus, or when a switch and the like for cleaning is operated by a user who recognizes that the quality of a recording image is deteriorated. After forced discharge of ink from the discharge ports, and, then, wiping operation is done to wipe the discharge port forming surface with the wiping member made of an elastic plate such as rubber. Moreover, there has been a trial in which the bubbles remaining in the ink flow paths are exhausted by the high flow speed of ink in the ink flow paths under application of the large negative pressure on the discharge-port forming surface under capping by driving the suction pump at a high speed at cleaning operation which is performed at initial filling of ink, at which ink is filled in the recording head for the first time, or at exchanging of the ink tanks.

However, as that the sectional areas of the ink flow paths are also increased when the areas of the filter members are made larger in order to control dynamic pressures at the filter members in the ink supply paths, the high flow speed of ink is not generated at the above-described cleaning operation even under application of the large negative pressure in the ink flow paths. Thereby, it is extremely difficult to remove the remaining bubbles from the discharge ports with the suction pump. That is, as a predetermined flow speed is required for the ink passing through the filters as one condition on which the bubbles can pass through the filters by an ink flow generated by the negative pressure caused with the suction pump, the pressure difference across the filters is required to be large in order to generate the predetermined flow speed. In order to realize the pressure difference, it is usually considered to reduce the filter areas for increase in flow path resistance, or to adopt a suction pump with a large flow rate. However, the ink is wastefully consumed, because the supply performance of the ink to the recording head is deteriorated when the filter areas are reduced, and a large amount of ink is discharged when the gas is removed with the suction pump with a large flow rate.

Accordingly, there are two other methods by which bubbles are removed: a method by which bubbles are directly discharged to the outside; and another method by which bubbles are moved to, and are remaining in regions in which the bubbles do not block ink supply. But, the former method, by which a communication port communicating with the outside is arranged in the ink supply paths, among the above two methods is judged not to be preferable, based on the after-described reasons.

(2) Method by which Bubbles are Directly Exhausted to the Outside

In many ordinary ink jet recording apparatuses, a negative pressure is generated in ink storage space of ink tanks in order to prevent an unfavorable leakage of ink from discharge ports of a recording head by disposing capillary force generation members such as absorbers in the ink tanks, or, by arranging elastic members such as springs in flexible ink storage bags to apply an urging force to the ink storage bags so that the inner volumes of the bags are increased. In such a case, when a mere communication port through which bubbles are directly exhausted to the outside is arranged in an ink supply path, air enters into the space from the communication port and the negative pressure will be released. Accordingly, it is required to dispose a pressure-regulating valve and the like at the communication port, and the structure of an ink supply system, that is, the recording apparatus is made complex, or large. Moreover, in order to prevent a leakage of ink from a discharge port which exhausts bubbles, it is required to dispose a water-repelling film and the like through which a gas can pass, but liquid can not pass, or, to adopt a device (a mechanism for detection of the amount of bubbles, an opening and closing mechanism for the communication port, and the like) by which the communication port is opened to exhaust bubbles only when there are remaining bubbles, and, then, there is a possibility that the manufacturing costs are increased and the structure is made complex and larger.

(3) Method by which Bubbles are Moved to, and are Remaining in Regions (for Example, Ink Tanks) in which the Bubbles do not Block Ink Supply Then, a method by which bubbles are moved to, and are remaining in regions (for example, ink tanks) in which the bubbles do not block ink supply will be considered. In such a method, the inner volume of the ink tank can be configured to be unchanged, and a generated negative pressure can be assumed to be constant, if it is possible to transfer an amount of ink corresponding to the volume of bubbles moving to an ink tank. The above configuration is preferable, because the negative pressure in equilibrium with a holding force for a meniscus formed at a discharge port can be applied on the recording head. Moreover, a gas can be completely removed from the ink supply system when the ink tank is of a cartridge form, because the ink tank is exchanged for a new one when the remaining amount of the ink for storing runs out of the tank.

Here, it is considered to be effective in order to smoothly transfer the gas to the side of the ink tank that an expanded section is provided in an ink supply path in which a filter member is arranged, as described above; and, furthermore, a portion in the upstream side of the filter member in the expanded section is formed to be, for example, tapered toward the upstream side; that is, the ink supply path running from the ink supply needle in the side of the recording head toward an installing position of the filter member is formed not to rapidly be expanded. However, in many ink jet recording apparatuses which has been widely widespread for household use ink tanks in a cartridge form, which separately store black ink and color ink, are configured to be installed in the recording head or a carriage equipped with the head in such a way that the ink tanks can be installed from the top in a detachable manner. The ink cartridge has, for example, a configuration in which the ink can be supplied to the recording head by plunging a hollow ink supply needle, which is installed upward in the carriage, into the cartridge. Therefore, the pipe diameter of the ink supply needle connecting the ink cartridge and the recording head is an important factor. In other words, a thin ink supply needle is required in order to make installation operation of the cartridge simple, but when the ink supply needle is thin, a force of an ink meniscus formed at a pipe section becomes too large to smoothly move the bubbles.

(4) Proposed Example of a Mechanism by which a Gas is Moved to the Side of an Ink Tank Some mechanisms by which the gas is moved to the side of the ink tank have been proposed so far.

For example, the Japanese Patent Application Laid-Open No. H05-96744 has disclosed a configuration in which the side of the recording head is separated to a first chamber comprising an air communication port and a second chamber comprising a capillary force generation member, wherein air is supplied to the side of the ink tank through one of the communication paths by connecting the first chamber and the ink tank through two or more communication paths which are different in the heights of openings at the side of the first chamber. In this configuration, the air communication port can be arranged in the first chamber, because a negative pressure is applied to ink in a recording head by the ink head difference between the first chamber and the second chamber, or with the capillary force generation member arranged in the second chamber.

Moreover, the U.S. Pat. No. 6,460,984 has disclosed a configuration in which when it is assumed that a storage chamber for a negative pressure generation member and a liquid storage chamber can be separated, a gas can be securely taken in by arranging a gas priority intake path and a liquid flow-out path in a communication section which connects the intake path and the flow-out path.

Furthermore, the U.S. Pat. No. 6,347,863 has disclosed an ink container (ink container 50) in which a liquid flow-out pipe (drain conduits 66, 72, 74), and a gas intake pipe (vent conduits 76, 82, 84) are protruding downward, wherein an upper opening of the liquid flow-out pipe and an opening of the gas intake pipe are arranged on a bottom surface of an inner wall and inside a storage space for the ink container, respectively.

Moreover, the U.S. Pat. No. 6,022,102 has disclosed a configuration in which a replenisher tank can be connected to a reservoir tank comprising a storage chamber for a negative pressure generation member and an ink storage chamber. And, when the replenisher tanks are connected to the upper portion and the lower one of the space of the ink storage chamber, ink is taken into the ink storage chamber from the replenisher tank through a liquid communication pipe at the lower portion, and air is taken into the side of the replenisher tank from the ink storage chamber through an gas communication pipe at the upper portion.

Furthermore, the U.S. Pat. No. 6,520,630 has disclosed a configuration in which a sub-tank for adding ink to a main tank communicated with a recording head is installed in the upper portion of a main tank, a gas in the main tank is taken into the sub-tank by acceleration and deceleration of a carriage, and ink in the sub-tank is supplied to the inside of the main tank.

However, according to the configuration disclosed in the Japanese Patent Application Laid-Open No. H05-96744, air is taken in the ink tank, depending on the supply of ink, in order to consume the ink in the ink tank which will not change its shape, and the object is not to remove bubbles remaining in an ink supply path. Especially, the negative pressure is not generated in the first chamber which is the ink supply path, and the first chamber is in contact with the atmosphere at any time, because the first chamber is open to the atmosphere through the air communication port. But, the Publication has described no matter unique to a sealed ink supply system at all, that is, in the Publication, there has been no description on the exhaust of the gas which is remaining in the ink supply path of a sealed system formed between the ink tank and the recording head.

Moreover, in the U.S. Pat. No. 6,460,984, there has been described only on a configuration in which the capillary force generation member and the air communication port are arranged between the ink tank and the recording head, and the ink supply path, in the same manner as that of the Japanese Patent Application Laid-Open No. H05-96744, is a system which is open to the atmospheric, and allows free passage of a gas through from the opening as an air communication port. But, the Publication has described no matter unique to a sealed ink supply system at all, that is, in the Publication, there has been no description on the exhaust of the gas which is remaining in the ink supply path of a sealed system formed between the ink tank and the recording head.

Furthermore, the object of technologies disclosed in the U.S. Pat. No. 6,347,863 is to provide a system in which the member (14) comprising the reservoir (reservoir 16, 18, 20) is refilled with ink, but not to remove bubbles remaining in the ink supply path downstream from the reservoir, and in portions using ink. Moreover, it is considered that, as the heights of the openings at the lower portions of the liquid flow-out pipe and the gas intake pipe are equal to each other, liquid and gas cannot be moved when the menisci of ink is formed in the above pipes. In addition, as there are no communication ports realizing communication between the ink storage container and the member (14), and no elements adjusting the negative pressure there is a possibility that, when use of ink is continued, the negative pressure in the inside rapidly rises and ink can not be supplied to portions using the ink.

Moreover, the configuration common to the above patent documents is a configuration in which the liquid storage section (ink tank) which can be separated is in communication with the side of the recording head through a plurality of communication paths, and the air intake unit is provided at a position downstream from the above communication paths (at the side of the recording head). Hereinafter, disadvantages of the configuration according to the U.S. Pat. No. 6,520,630 as a typical example will be described.

FIG. 9 shows a conceptual view of the configuration disclosed in the U.S. Pat. No. 6,520,630. Assuming that the air movement (gas movement to a sub-tank 22 through a pipe 56A) is stopped, the balance among forces applied on the ink meniscus section formed in a pipe 56A will be studied, referring to FIG. 9. In the first place, forces applied downward are a head pressure P1 of ink in the sub-tank 22, and a meniscus force formed at an opening section of the pipe 56A. Moreover, a force applied upward is a pressure P2 by a gas in a main tank 20. The air movement has stopped, because balance among the above forces is realized. In this case, the pressure P2 of the gas in the main tank 20 and a head pressure P3 at the position of the ink liquid level in the main tank 20 are balanced with each other. In addition, as the inside of the sub-tank 22 and that of the main tank 20 are communicated with each other through a pipe 56B, the difference between the downward ink pressure which is applied on the meniscus formed in the pipe 56A and the gas pressure P2 in the main tank 20 is equal to a head pressure difference P4 between the head pressure at the position of the meniscus and that of the liquid level in the main tank 20. Consequently, the head pressure difference P4 and the meniscus pressure are balanced with each other to cause an equilibrium state.

For example, when bubbles are further taken in from the bubble generation device 104 in the above equilibrium state, the liquid level in the main tank 20 gets low, and the head pressure difference P4 between the menisci in the pipe 56A and the liquid level is increased. And, when the head pressure difference P4 exceeds the meniscus pressure, the gas in the main tank 20 is taken into the sub-tank 22 (air movement) through the 56A, and the ink in the sub-tank 22 is supplied to the main tank 20 through the pipe 56B, along with the air movement.

However, as there is caused ink flow in the whole supply system in FIG. 9 when ink is discharged with a recording head 18, pressure loss corresponding to the quantity of the ink flow in the pipe 56B is generated in the sub-tank 22 and the main tank 20. Thereby, the pressure loss is required to be considered for the relation between the above-described meniscus pressure and the head pressure difference P4 (head pressure difference between the meniscus and the liquid level). Consequentially, when the head pressure difference P4 is larger than a pressure which is obtained by adding the pressure loss to the above-described meniscus pressure, air movement will be generated. In other words, in a state in which ink is discharged, gas-liquid exchange (air-ink exchange) is not performed unless comparing with a state in which air movement is stopped, unless the ink liquid surface in the main tank 20 gets low by the pressure loss of the pipe 56B corresponding to the quantity of the ink flow. When the ink liquid level at gas-liquid exchange is lower than the opening section of the pipe 56B, the gas-liquid exchange is not done, and the ink in the main tank 20 is completely used without using the ink in the sub-tank 22.

Accordingly, when the pipes 56A and 56B are made thinner for simple operation by which the tank is installed as described above, the pressure loss corresponding to the quantity of the ink flow is increased, and the ink liquid level in the main tank 20 at gas-liquid exchange gets low. Therefore, the size of the main tank 20 is increased, and, consequently, the size of the whole recording apparatus becomes large.

In addition, there is a possibility, as another issue, that bubbles generated in a bubble generation device 104 are drawn into a flow path in communication with the recording head when ink is discharged for the recording head 18, because the bubble generation device 104 is disposed in the lower portion of the main tank 20. Especially, when the quantity of the ink flow is increased for high speed recording, use-up of ink, and drawing of bubbles into the recording head 18 are easily occurs. Therefore, when the quantity of the ink flow caused by ink discharge of the recording head 18 is restricted, or when the bubble generation device 104 is separated from a filter 39, the size of the main tank 20 is further increased in order to prevent such drawing of the bubbles.

These disadvantages are similarly applied to a configuration in which an air intake unit is provided not in a communication path between a recording head and an ink tank, but in the side of the recording head, that is, to the configuration disclosed in the U.S. Pat. No. 6,022,102. As the U.S. Pat. No. 6,520,630 has the configuration in which the unit (bubble generation device 104) by which air is taken into the main tank 20 is provided while the main tank 20 in communication with the sub-tank 22 comprises a flexible ink bag 100, the above-described disadvantages are similarly applied to the Publication U.S. Pat. No. 6,520,630, like the Publication U.S. Pat. No. 6,022,102.

As described above, the above-described patent literatures have disclosed that a gas is taken into the ink tanks. But, the Publication has described no matter unique to a sealed ink supply system at all, that is, in the Publication, there has been no description on the exhaust of the gas which is remaining in the ink supply path of a sealed system formed between the ink tank and the recording head. Moreover, the publications have included no description on the smooth transfer of the gas in the ink supply path of the sealed system to the side of the ink tank for remaining of the gas therein.

SUMMARY OF THE INVENTION

The object of the present invention is to provide an ink supply system, a recording apparatus, a recording head, and a liquid supply system, by which, a gas blocking operations for use and supply of ink (liquid) is quickly and smoothly exhausted from the inside of an ink supply path (liquid supply path) as a sealed system, which is formed between an ink tank (liquid storage section) and a recording head (liquid use section), without using a complex structure.

Moreover, another object of the present invention is to prevent generation of poor recording in use of ink by smooth and quick transfer of a gas remaining in the ink supply path with a sealed structure to the side of the ink tank, while the generation is caused by problems caused by bubbles remaining in the ink supply paths, that is, by poor ink supply to a recording head, by clogging of discharge ports caused by bubbles mixed into ink, and the like.

Furthermore, further another object of the present invention is to realize recording operations by which large quantity of ink is supplied at a high speed without increasing the size of the whole ink supply system.

In order to achieve the above-described objects, one aspect of the present invention provides an ink supply system, characterized in that the system comprises an ink tank which contains ink, and a liquid chamber which is connected to the ink tank through a plurality of communication paths, and supplies ink taken from the ink tank to a recording head, wherein the liquid chamber, except the plurality of communication paths and a connection section to the recording head, forms a substantially sealed space; the liquid chamber is provided with a filter which can partition the inside of the liquid chamber in to a first region at the side of the ink tank and a second region at the side of the recording head, and can form a meniscus of ink which is broken by a pressure of gas in the second region.

Moreover, another aspect of the invention provides a liquid supply system, characterized in that the system comprises: a liquid storage section which contains liquid; and a liquid chamber which is connected to the liquid storage section through a plurality of communication paths, and supplies the liquid taken in from the liquid storage section to a liquid use section, wherein the liquid chamber, except the plurality of communication paths and a connection section to the liquid use section, forms a substantially sealed space; the liquid chamber is provided with a filter which partitions the inside of the liquid chamber into a first region at the side of the liquid storage container section and a second region at the side of the liquid use section, and can form a meniscus of liquid which is moved from the second region to the first region by a pressure of gas in the second region.

According to the present invention, as the liquid supply path of a sealed system located between the liquid storage section and the liquid use section comprises the liquid chamber, and the gas in the liquid chamber is transferred to the inside of the liquid storage section through the filter provided in the liquid chamber, the gas which blocks liquid use operation and liquid supply operation can be quickly and smoothly exhausted without using a complex structure.

Moreover, when the present invention is applied to a recording apparatus using an ink jet recording head, and the like, the gas remaining in the ink supply path of a sealed structure is quickly and smoothly transferred to the side of the ink tank, and, at the same time, even when the recording apparatus is actually used, poor recording caused by problems caused by remaining bubbles, that is, by clogging of the discharge port due to poor ink supply and bubble's mixed into ink, and the like can be prevented.

Moreover, when ink including a pigment as a color material is used, the preservation stability of ink and the reliability of ink discharge can be secured by diffusing settled pigment particles in transfer of gas to the ink tank.

Furthermore, as the outside air is not directly taken into the liquid chamber when ink is used, and the gas in the liquid chamber is exhausted into the ink tank when an ink tank is exchanged, there is no possibility that bubbles are drawn into the side of the recording head. Moreover, the liquid chamber can have a compact configuration, and, among a plurality of flow paths between the liquid chamber and the ink tank, a flow path which exhausts mainly gas can be also used as a path for ink supply to realize a plurality of flow paths with a compact configuration.

Moreover, wasteful ink consumption can be suppressed, as a large quantity of ink is not required to be sucked and exhausted from the nozzle section of the recording head for sucking and exhausting of gas from the recording head together with ink along with cleaning by transferring the gas generated in the first region at side of the recording head from the filter to the second region at side of the ink tank side by the filter disposed in the liquid chamber without using a complex mechanism or additional power. Furthermore, as sucking and exhausting operation of ink from the recording head is not required, and there is no need to prepare a suction pump and the like for the recording apparatus, the recording apparatus can have a further compact configuration.

And, as gas is not mixed into the recording head in the recording apparatus, and ink is supplied in a stable manner, improvements in the recording performance and the reliability of the recording apparatus and the recording head, and the reduction in the cost can be simultaneously realized.

DETAILED DESCRIPTION OF THE PREFERRED DESCRIPTION

Figure 1:
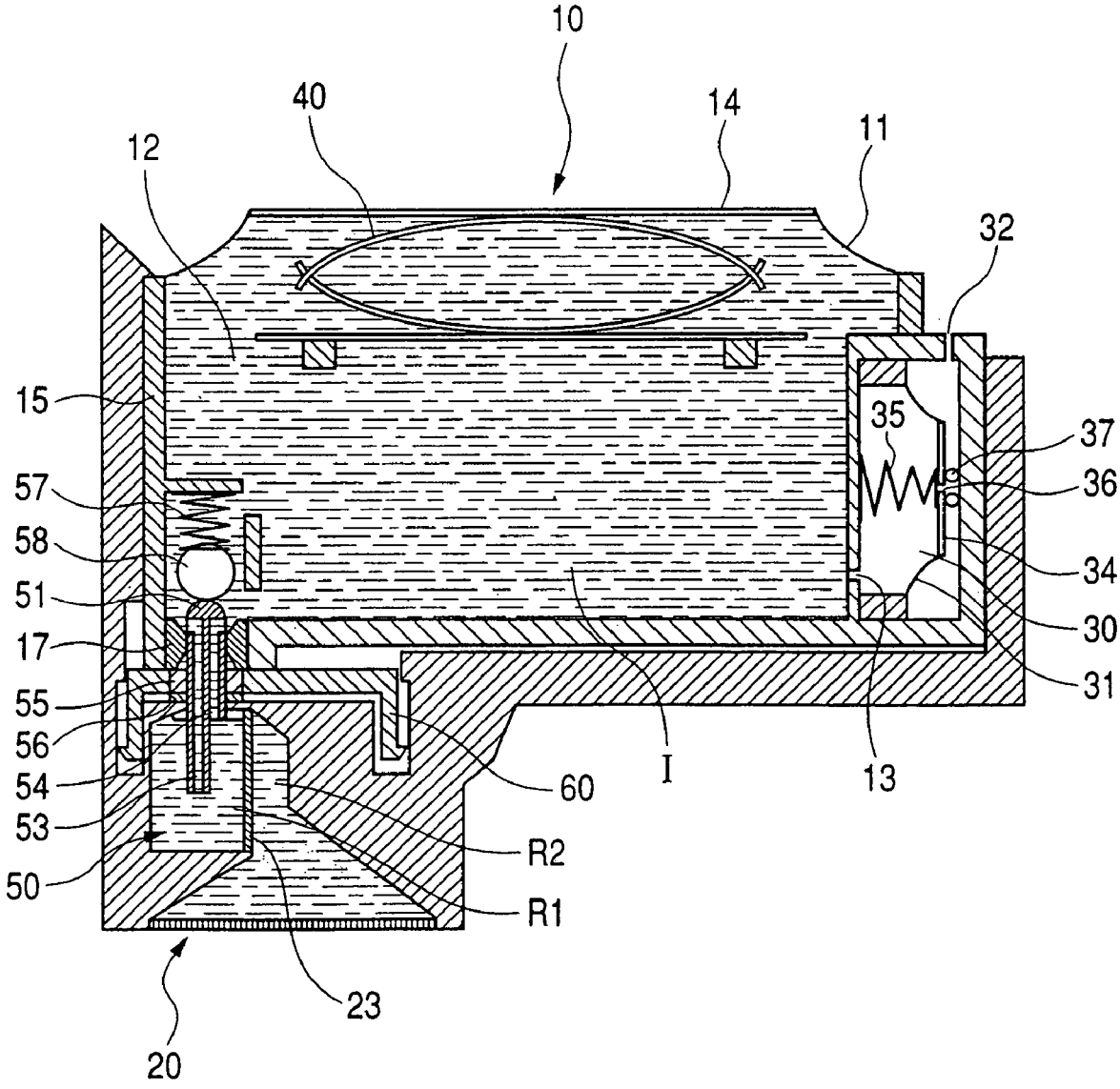
FIG. 1 is an exemplary cross section of a liquid supply system according to the first embodiment of the present invention.

Hereinafter, the preferred embodiments will be explained, referring to the drawings.

In the present description, "recording" means not only that significant information such as characters and figures is formed, but also that images, designs, patterns and the like are formed on recording medium, or that the recording medium is processed, whether it is significant or insignificant, and whether it is obvious or not by human's eyes. Moreover, "record medium" means not only paper used for a common recording apparatus, but also a cloth, a plastic film, a metallic plate, and things comprising materials, such as glass, ceramics, wood, and leather, which can receive ink. But, hereinafter, "record medium" is called "sheet of paper", or "paper".

Here, although, in the following embodiments, ink is referred as a liquid used for a liquid supply system in the present invention, an applicable liquid is not limited to ink, and it is natural that the applicable liquid includes a processing solvent for the recording medium, for example, in a field of ink jet recording.

First Embodiment

FIG. 1 is an exemplary cross section of a liquid supply system according to the first embodiment of the present invention. Generally, an ink supply system in FIG. 1 comprises: an ink tank 10 as a liquid storage container; an ink jet recording head 20 (hereinafter, called only "recording head"); and a liquid chamber 50 forming an ink supply path for connection therebetween. Although, in the present embodiment, the liquid chamber 50 and the recording head 20 are integrated into one body so that the chamber 50 and the head 20 can not be separated, the chamber 50 may be configured to be done so that the chamber 50 and the recording head 20 can be separated. Moreover, there may be a configuration in which the liquid chamber 50 is provided in a carriage equipped with the recording head 20, the ink tank 10 can be detached from the upper portion of the carriage, and an ink supply path from the ink tank 10 to the recording head 20 is formed when the ink tank 10 is installed.

Generally, the ink tank 10 comprises two chamber, that is, an ink storage chamber 12 as an ink storage space, and a valve chamber 30, wherein the insides of the chambers 12 and 30 are in communication with each other through a communication path 13. Ink I which is discharged from the recording head 20 is stored in the ink storage chamber 12, and is supplied to the recording head 20 along with the discharge operation.

A flexible film 11 (sheet member) the shape of which can be changed is disposed in a part of the ink storage chamber 12, and the space for storage of ink is formed with the flexible film and an inflexible exterior component 15. The outside space of the ink storage space seen from the sheet member 11, that is, the upper space of the sheet member 11 in FIG. 1 is configured to be open to the atmosphere and the atmospheric pressure is kept at the upper space. Moreover, the ink storage space, except a connection section to the liquid chamber 50 which is provided at the lower portion and the communication path 13 to the valve chamber 30, substantially forms a sealed space.

The shape of a central portion of the sheet member 11 in the present example is restricted by a pressure plate 14 which is a flat-shaped supporting member, and the form of the peripheral portion can be changed. Moreover, the sheet member 11 is formed in a convex shape at the central portion beforehand, and has an approximately trapezoidal shape as a side view. This sheet member 11 is, as described later, deformed according to changes in the quantity of ink and the pressure change in the ink storage space. In this case, the peripheral portion of the sheet member 11 is deformed in good balance so that the central portion is vertically moved parallel while the horizontal position of the central portion is kept. As the sheet member 11 is smoothly deformed (moved) as described above, no shock caused by deformation is not generated, and abnormal pressure changes in the ink storage space, which are caused by the shock do not arise.

And, there is provided in the ink storage space a spring member 40 in a compression form by which the sheet member 11 is urged through the pressure plate 14 in the upward direction in the drawing. As a pressing force of the spring member 40 and a holding force for a meniscus of ink formed in an ink discharge section of the recording head 20 are in balance, a negative pressure is generated so that ink discharge operation of the recording head 20 is performed. Furthermore, when the volume of air in the ink storage chamber 12 is changed by environmental changes (changes in the ambient temperature and the atmospheric pressure), the negative pressure in the ink storage chamber 12 is configured not to remarkably be changed, because the displacements of the spring member 40 and the sheet member 11 receive the volume change. FIG. 1 shows that ink is approximately completely filled in the ink storage space, and the spring member 40 is compressed even under the fully filled state. Based on the state shown in FIG. 1, it can be assumed that the negative pressure is appropriately generated in the ink storage space.

When the negative pressure in the ink tank 10 is increased to a value equal to or larger than a predetermined one, a gas (air) is taken into the valve chamber 30, and a one-way valve which stops a leakage of ink from the ink tank 10 is provided in the chamber 30. The one-way valve comprises: a pressure plate 34, as a valve closing member, with a communication port 36; a sealing member 37 which is fixed at a position, facing the communication port 36, on the inner wall of the casing of the valve chamber and can seal the port 36; and a sheet member 31 which is connected to the pressure plate 34 and into which the port 36 penetrates. The valve chamber 30, except the communication port 13 to the ink tank 10 and the communication port 36 to the atmosphere, substantially keeps a sealed space. And, the space in the casing of the valve chamber at the right side from the sheet member 31 in the drawing is configured to be open to the atmosphere with an air communication port 32 and the atmospheric pressure is kept at the upper space.

The sheet member 31 can be deformed in the peripheral portion except the central portion connected to the pressure plate 34, and formed in a convex shape at the central portion, and has an approximately trapezoidal shape as a side view. The movement of the pressure plate 34 as a valve closing member in the horizontal direction in the drawing is smoothly performed by adopting of the above configuration.

A spring member 35 as a valve restriction member which restricts valve opening operation is provided in the valve chamber 30.

The spring member 35 is also compressed a little, and is configured to press the pressure plate 34 in the right direction in the drawing by a reaction force of the compression. The expansion and compression of the spring member 35 causes contact/separation of the sealing member 37 with/from the communication port 36 for a valve function, and, furthermore, for a one-way valve which allows only air intake through the communication port 36 from the air communication port 32 into the valve chamber 30.

Any members which can securely seal the communication port 36 may be applied as the sealing member 37. That is, any members which can secure a sealed state, such as a member which has a flat shape to the opening surface of the communication port 36 at a portion contacting at least the communication port 36, a member including a rib which can contact with a circumferential portion of the communication port 36, or a member in which the tip portion is plunged into the communication port 36 so that the shape of the port 36 is changed for sealing may be applied for the member 37, and the material for the member 37 is not especially limited. However, as such sealing is realized by an extension force of the spring member 35, it is preferable to form the sealing member 31 with an elastic body, such as rubber, with a contractile property so that the sealing member 31 and the pressure plate 34 can be easily moved by an action of the extension force.

In the ink tank 10 with the above-described configuration, ink consumption starts from the initial state in which ink is fully filled as shown in FIG. 1. Then, the ink consumption is continued during a state in which the negative pressure in the ink storage chamber 12 and a force caused by the valve restriction member (spring member 35) in the valve chamber 30 are in balance, and the communication port 36 is opened at the moment when the negative pressure in the ink storage chamber 12 is further increased. Consequently, flow of the atmosphere into the ink storage chamber 12 is caused, and, then, the atmosphere is taken into the ink storage space. And, the sheet member 11 and the pressure plate 14 are displaced upward in the drawing by the above taken-in atmosphere to increase the volume of the ink storage chamber 12, and, at the same time, to reclose the communication port 36 by weakened negative pressure in the ink storage chamber 12.

Moreover, even if changes in the surrounding environment of the ink tank 10, for example, increase in the temperature, or reduction in the pressure is caused, the air taken into the ink storage space is allowed to be expanded by changes in the volume of the ink storage chamber 12, which are caused by displacement to the initial position as shown in FIG. 1 from the maximum downward-displacement position of the sheet member 11 and the pressure plate 14. In other words, the space of the change in the pressure caused by the displacement of the sheet member 11 and the pressure plate 14 functions as a buffer region, and can reduce the rise in the pressure according to the changes in the surrounding environment and effectively prevent a leakage of ink from the discharge port of the recording head 20.

Furthermore, as the outside air is not taken into the ink storage space from the initial state of filling as shown in FIG. 1 to a time point in which the buffer region is secured by reduction in the inner volume of the ink storage space along with the ink consumption, a leakage of ink is not generated before the time point even when there are caused rapid changes in the surrounding environment, vibrations, falls, and the like. In addition, as the buffer region is secured neither beforehand nor before use of ink, the volume efficiency of the ink tank 10 is high to cause a compact configuration.

Although the spring 40 in the ink storage chamber 12 is of a plate spring form, and the spring 35 in the valve chamber 30 is of a conical spring form in the example shown as an exemplary one in the drawing, it is obvious that springs with other forms can be used in place of the above springs.

In the example shown in the drawing, the recording head 20 and the ink tank 10 are connected with each other by inserting a connection section 51 in the liquid chamber 50, which is integrated into the recording head 20 as one body, into the ink tank 10. Thereby, the head 20 and the tank 10 are connected from a view point of a fluid, and, then, ink can be supplied from the ink tank 10 to the recording head 20. A sealing member 17 such as rubber is installed in the opening on the side of the ink tank 10 into which the connection section 51 is inserted, and contacting of the sealing member 17 with the circumferential portion of the connection section 51 prevents a leakage of ink from the ink tank 10 and secures connection between the connection section 51 and the ink tank 10. In the sealing member 17, slits and the like may be formed at a position, at which the section 51 is inserted, beforehand in order to secure easy insertion of the connection section 51. When the connection section 51 is not inserted, the ink leakage is prevented by closing the slits by an elastic force of the sealing member 17 itself.

The portion of the sealing member 17, into which the connection section 51 is inserted is sealed by a ball 58, which is pressed downward with a spring 57, when the connection section 51 is not inserted into the portion, and, when the connection section 51 is inserted, the ball 58 is moved upward against a force caused by the spring 57 as shown in FIG. 1.

Moreover, a movable body 60 which can be vertically displaced is fitted into the upper portion of the liquid chamber 50. The movable body 60 is urged upward with the spring 56, and, when the recording head 20 and the ink tank 10 are connected with each other, is displaced downward against a force caused by the spring 56 as shown in FIG. 1. When the recording head 20 and the ink tank 10 are separated from each other, the movable body 60 is displaced with the spring 56, and the sealing member 55 installed on the movable body 60 seals the opening of passages 53 and 54 described later at the side of the ink storage chamber 12.

The connection section 51 comprises a hollow-needle type member the inside of which is divided into two portions along the axis direction. The upper sides of each hollow section, that is, the opening positions (hereafter, called "Tank side opening position") in the ink storage chamber 12 have almost the same height as each other with regard to the vertical direction. On the other hand, the lower sides of each hollow section, that is, the opening positions (hereafter, called "Head side opening position") in the liquid chamber 50 connected with the recording head 20 have different heights from each other. Hereinafter, a flow path (a flow path formed with the hollow section at the left side in FIG. 1) in which the head side opening position is at a relatively lower portion in the vertical direction is called an ink flow path 53, and a flow path (a flow path formed with the hollow section at the right side in FIG. 1) in which the head side opening position is at a relatively upper portion in the vertical direction is called an air flow path 54. However, the main reason is that in the exhaust process of bubbles, ink is flown out from the ink flow path 53 to the side of the recording head 20, and gas is transferred from the air flow path 54 to the side of the ink tank 10. Accordingly, both of the ink and the gas are moved in those flow paths 53 and 54 as described later. That is, the names of those flow paths do not mean that the paths are used only for the fluid corresponding to the names.

The ink supply path in the liquid chamber 50 is divided with a filter 23 extending in the vertical direction into a first region R1 at the side of the ink tank (the upstream portion of the filter) and a second region R2 at the side of the recording head (the downstream portion of the filter). The filter 23 prevents impurities mixed in the ink supplied from the ink tank 10 from flowing into the recording head 20. The area of a gas-liquid interface between the gas and the liquid in the liquid chamber 50, which is formed by remaining gas, is larger than the horizontal sectional area of the flow paths 53 and 54. Thereby, when the head pressure difference in the ink tank 10 is applied in the liquid chamber 50 through the ink flow path 53, the pressure of the gas existing in the liquid chamber 50 is further increased, and the gas can be easily exhausted toward the ink tank 10 from the air flow path 54.

The recording head 20 comprises: a plurality of discharge ports arranged in a predetermined direction (for example, in a different direction from the moving direction of the head 20 when there is adopted a serial recording method in which discharge operation of the head 20 installed on a member such as the carriage as described later is performed, while the head 20 is moved relatively to the recording medium); liquid paths in communication with each discharge port; and elements which are arranged in the liquid paths and generate energy which is used for discharging ink. Here, the ink discharge method, for the recording head, that is, the form of the energy generation element is not especially limited. For example, thermal energy generated by using an electrical heat converter (heater) which generates heat according to energizing may be used for ink discharge. In this case, film boiling is generated in ink by heat of the electrical heat converter, and ink can be discharged from the ink discharge port by bubbling energy at that time. Moreover, ink may be discharged, using mechanical energy caused by an electromechanical transducer, such as a piezoelectric element, which deforms according to applied voltages.

As described above, the recording head 20 and the liquid chamber 50 may be integrated into one body in a separable or non-detachable manner, or may be separately formed so that they are connected with each other through a communication path. When they are integrated into one body, a form in which a cartridge is provided in a member installed in the recording apparatus in a detachable manner can be also applied.

Then, a process of a method, which exhausts bubbles, according to the present embodiment will be explained, referring to FIGS. 2A through 2D. FIGS. 2A through 2D show only portions required for explanation of an operation mechanism, and portions related with the valve chamber 30 in the ink tank 10 are eliminated in the drawing.

Figure 2A:
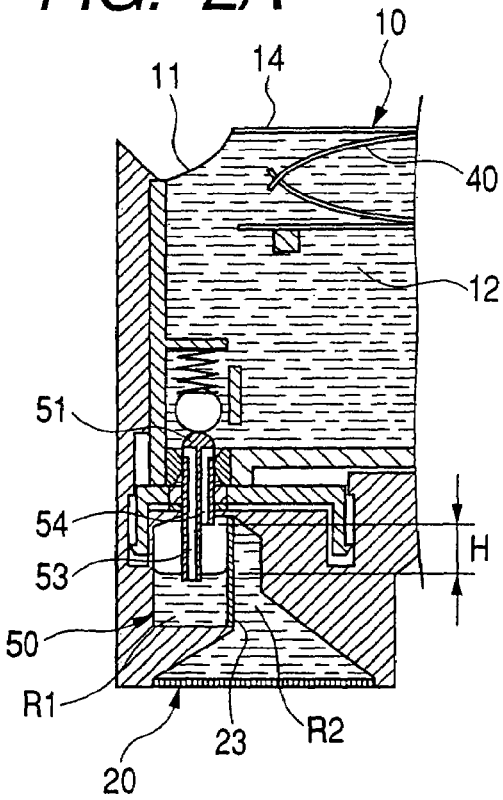
FIGS. 2A, 2B, 2C and 2D are exemplary cross sections explaining an exhaust mechanism of air in a first region in the liquid supply system shown in FIG. 1.

FIG. 2A shows a state just after the ink tank 10, which is completely filled with ink, is installed in the recording head 20 in place of another ink tank 10 which has been emptied after full consumption of ink. As recording has been continued, using ink remaining in the liquid chamber 50 even if the ink tank 10 which has been installed is emptied, air enters from the side of the ink tank 10, and is remaining at the upper portion of the first region R1 (an upstream area of the filter 23) in the liquid chamber 50 at the side of the recording head 20. Moreover, even small quantity of air exists in the second region R2 (downstream region of the filter 23), and the heights of the gas-liquid interfaces for the first region R1 and the second region R2 are different from each other by a difference H. However, a very small meniscus of ink is formed in the filter 23 by a capillary force of the filter 23, and, then, the air in the first region R1 cannot be moved to the inside of the second region R2. Furthermore, there may be a portion in which the first region R1 and the second region R2 are in communication with each other, based on a broken meniscus of ink formed in the filter 23. In this case, the heights of the gas-liquid interfaces for the first region R1 and the second region R2 are equal to each other by movement of the atmosphere (air) from the first region R1 to the second region R2.

Moreover, menisci of ink are formed in the ink flow paths 53 and 54 in the connection section 51, respectively, and a state (state of FIG. 2A) in which the pressures are in balance by the menisci of ink is caused to stop the movement of the air (gas) and the ink (liquid). According to the volume of the gas at the side of the liquid chamber 50, the gas movement is not stopped and the gas is moved to the side of the ink tank 10 for complete removal of the gas in some cases. However, the gas to be removed remains in the liquid chamber 50 in the case of FIG. 2A.

Figure 2B:
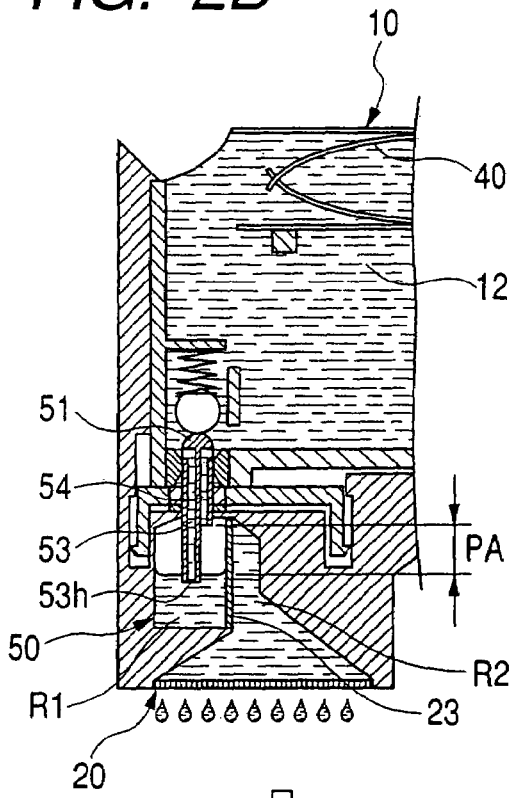

FIG. 2B is an exemplary view of a state in which ink is discharged as a droplet from the recording head 20. By the discharge of ink the negative pressure in the recording head 20 and the liquid chamber 50 is increased, the menisci of ink formed in the flow paths 53 and 54 of the connection section 51 is moved, and the ink in the flow paths 53 and 54 is moved from the ink tank 10 to the liquid chamber 50. Thereby, the inner volume of the ink storage chamber 12 is reduced, and the sheet member 11 is deformed downward under restriction by the pressure plate 14. Thereby, the spring member 40 is compressed to increase the negative pressure in the ink storage chamber 12.

In the present embodiment, the pipe diameters of the ink flow paths 53 and 54 are assumed to be almost equal to each other. Therefore, the pressure losses through the flow paths 53 and 54 are not so remarkably different from the negative pressures in the recording head 20 and the liquid chamber 50, and ink is supplied from the flow paths 53 and 54 to the liquid chamber 50. In a state shown in FIG. 2B, in which the head side opening 53*h* of the ink flow path 53 contacts with ink, ink flows from the ink flow path 53 into the liquid chamber 50, and bubbles caused in the liquid chamber 50 or the recording head 20 is moved to the first region R1 and remains in the first region R1, that is, in the upper portion of the liquid chamber 50 together with the gas which has already remained. In this state, even if a meniscus of ink is formed at a position of the head side opening 54*h* of the air flow path 54, the meniscus is broken and the ink is dropped, if the negative pressure in the recording head 20 or the liquid chamber 50 is high. In the present embodiment, as an operation other than ink discharge with a recording operation, or a recording operation there is caused, by ink discharge (preliminary discharge), a state in which the inside of the connection section 51 is filled with ink as shown in FIG. 25. However, a surface of the recording head 20, on which the discharge port is formed, is sealed with the cap member, and the state shown in FIG. 2B can be obtained by sucking and exhausting ink from the discharge port with the suction pump.

Figure 2C:
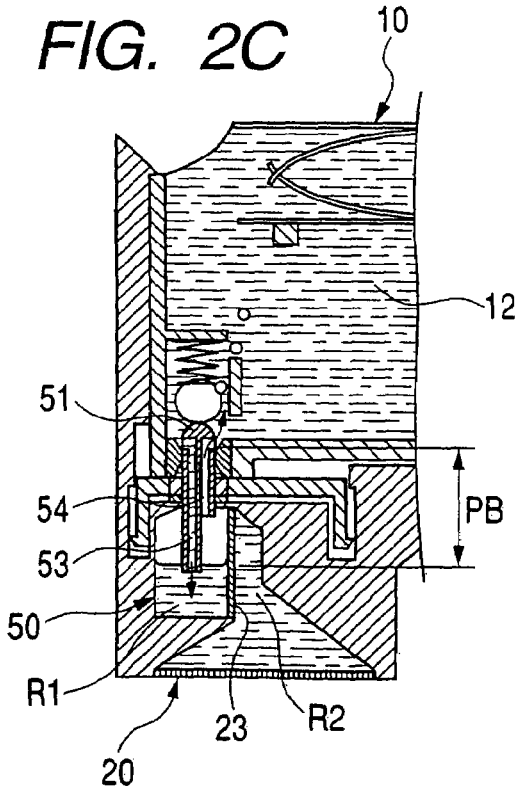

FIG. 2C is a view showing a state in which ink movement to the liquid chamber 50 and air exhausting (exhausting of the gas) to the ink tank 10 are simultaneously occurred after the ink discharge, or sucking and exhausting of ink from the ink discharge port is stopped. The reason for such operations is that a pressure PA caused by a head pressure difference between the gas-liquid interface in the first region R1 and the meniscus formed at the opening section at the side of the liquid chamber in the air flow path 54 is applied on the air in the first region R1, immediately after the ink discharge is stopped in the state shown in FIG. 2B, and the pressure PA is applied on the meniscus formed in the opening section at the side of the liquid chamber in the air flow path 54. That is, a force which causes air exhaust from the side of the first region R1 to the side of the ink tank 10 is generated in the air flow path 54, and, at the same time, a force which causes ink movement from the side of the ink tank 10 to the side of the first region R1 is generated in the ink flow path 53, and the ink movement to the side of the liquid chamber 50 and the air exhaust to the side of the ink tank 10 are simultaneously occurs by the above forces. Once the air exhaust starts, the pressure which is applied on the air in the first region R1 is the head pressure difference PB between the tank side opening position and the gas-liquid interface in the first region R1 in the air flow path 54. As the connection section 51 is disposed in the vertical direction, the head pressure difference is increased so that the pressure becomes PB, and the air exhaust is accelerated.

Figure 2D:
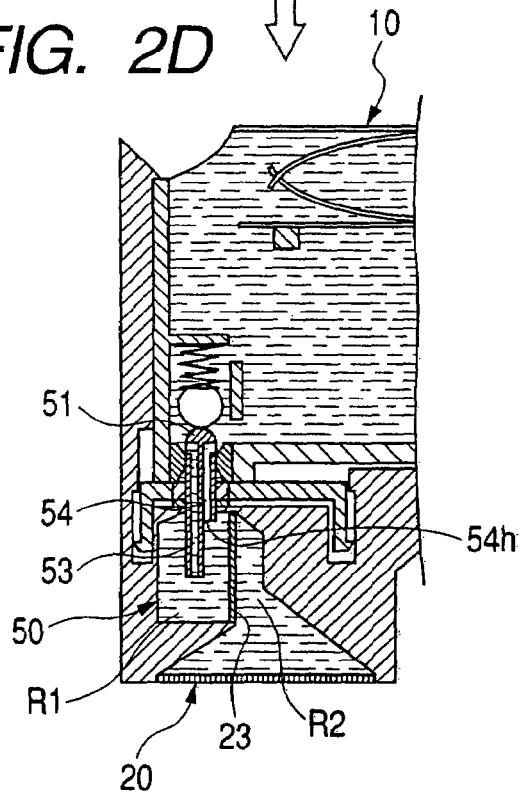

FIG. 2D is a view showing a state in which the gas-liquid interface in the first region R1 is raised to a position of the opening 54*h* at the side of the head in the air flow path 54, and all of the air in the air flow path 54 is exhausted. According to the pipe diameter of the air flow path 54 and the meniscus force, the air exhaust is not completed before the state shown in FIG. 2D and the ink movement is stopped, while the air is remaining in the air flow path 54 in some cases. There is no influence on the operations of the present invention even in this case.

Moreover, as the opening at the side of the liquid chamber in the air flow path 54 is protruding downward from the upper surface of the inner wall of the liquid chamber 50 in this configuration, the air in the first region R1 is not completely exhausted, and, surely, there exists remaining air in the region. The reason will be described later.

Moreover, although the air flow paths 54 and 53 are completely separated to form an independent communication paths in this configuration, very slight communication between them may be allowed. The reason is that the desired advantages are obtained without blocking the above-described air exhaust operation, if those flow paths 53 and 54 are in very slight communication with each other so that the meniscus forces formed in the very small communication sections between the flow paths 53 and 54 are increased, comparing with the meniscus forces formed at the opening sections in the flow paths 53 and 54 as considered here, the head pressure differences PA and PB, or the negative pressure in the ink tank 10 and the like. The above description is similarly applied to other embodiments which will be explained later.

The characteristic point in this configuration is that a unit by which air is directly taken into the ink supply system is disposed only in the ink tank 10. In other words, air is never taken into the liquid chamber 50 in a direct manner. Therefore, the above-described air exhaust operation is generated only when the ink tank is exchanged, and it is not required to consider it when ink is normally used. On the other hand, when air is directly taken into the liquid chamber (in an ink tank in the patent document 5) at the use of ink, it is required to consider conditions on which gas-liquid exchange liquid exchange can be realized even at use of ink.

As the position of the liquid level of ink is lowered by the pressure loss according to the quantity of ink flow when ink is used as described above, gas-liquid exchange can be realized in a statical state even under a condition, in which the opening section at the side of the liquid chamber in the ink flow path 53 contacts ink as shown in FIG. 2C when the ink is not used, but there is a possibility that such gas-liquid exchange can not be realized when ink is used. That is, as the length of the ink flow path 53 is limited, there is a possibility that the gas-liquid interface is located below the opening section at the side of the liquid chamber in the ink flow path 53 when the quantity of ink flow (the quantity of supplied ink) is increased when ink is used, and the level of the gas-liquid interface in the first region R1 where gas-liquid exchange can be performed is lowered. Thus, there is a limit quantity of ink flow by which the gas-liquid exchange is stopped when ink is used.

On the other hand, as air is no directly taken into the liquid chamber 50 in the present configuration, the liquid level in the liquid chamber 50 is not lowered even when ink is used. Therefore, the liquid chamber 50 can be designed to be a compact one. Moreover, ink is supplied not only from ink flow path 53, but also from the air flow path 54 when ink is used, and the reduction in the pressure loss at the connection section 51 can be realized. Thereby, a thin connection pipe (a component member for the flow paths 53 and 54) can be used for the connection section 51. Consequently, the whole ink supply system with a compact size can be realized.

Here, even in the present configuration, when ink is further consumed in the recording head 20 after complete consumption of the ink in the ink tank 10 the ink liquid level in the ink tank 10 is lowered to that of the liquid chamber 50, and there is a possibility that the air taken into the ink tank 10 enters the liquid chamber 50. However, as ink has not existed in the ink tank 10 and the connection section 51 already in this case, the pressure loss is not caused in those sections. Therefore, the quantity of ink flow by which the gas-liquid exchange can be realized is not limited in this case, too.

Furthermore, according to the present configuration, quick transfer of gas remaining in the first region R1 to the side of the ink tank 10 can be realized without requiring a complex configuration by a configuration in which the inside of the connection section 51 is divided into two sections to form the flow paths 53 and 54, and a difference is made between the heights of the head side opening position in the flow paths 53 and 54.

Moreover, if ink discharge of some quantity of ink from the recording head 20, or sucking of ink and the like from the side of the surface on which the discharge ports are formed is performed after an operation for exchange of the ink tank 10, the gas remaining in the liquid chamber 50 can be removed from the ink supply path by quick and smooth transfer to the side of the ink tank 10. Therefore, removal of gas by sucking operation of a large quantity of ink from the side of the discharge port in the recording head 20 is not required not to cause waste of a large quantity of ink.

Moreover, when the negative pressure in the ink storage chamber 12 is increased to a value equal to or larger than a predetermined one in the process of ink supply from the ink tank 10, as described above, gas is taken into the ink storage chamber 12 from the outside by action of the valve chamber 30.

Moreover, when ink including a pigment as a color material is used, the preservation stability of ink and the reliability of ink discharge can be secured by diffusing pigment particles settled in the ink tank 10 and the like in the transfer of the air in the liquid chamber 50 to the ink tank 10.

As described above, the operation mechanism by which the air in the first region R1 is transferred to the side of the ink tank 10 has been explained. Then, an operation mechanism by which the air remaining in the second area R2 is exhausted will be explained.

Figure 3A:
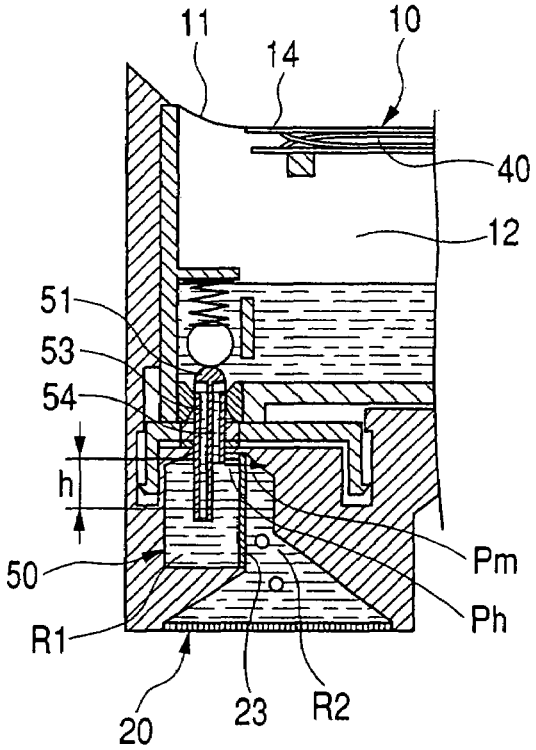
FIGS. 3A, 3B and 3C are exemplary cross sections explaining a movement mechanism of air in a second region in the liquid supply system shown in FIG. 1.

FIG. 3A is a view showing a state in which air is remaining in the second region R2. As described above, air enters into the first region R1 from the ink tank 10 when the ink in the liquid chamber 50 is continuously used after complete consumption of the ink in the ink tank 10. In other words, air will enter the first region R1 by all means at each exchange of the ink tank 10. However, the air which enters the second region R2 is only two kinds of air, that is, air generated along with the ink discharge from the ink discharge section of the recording head 20, and air which enters the inside from the outside after passing through materials forming the liquid chamber 50, except air which is moved from the first region R1 as described above. Although the quantity of the above air is generally very little, the recording operation is continued without exhausting the air, and, then, the air gradually remains in the second region R2 to cause a state shown in FIG. 3A.

In the state shown in FIG. 3A, the vertical difference between the level of the gas-liquid interface in the first region R1 and that in the second region R2 is h. As a lower portion of the filter 23 contacts with the ink in the first and second regions R1 and R2, movement of ink through a lower portion of the filter 23 can be realized. Therefore, the head pressure difference Ph which corresponds to the difference h in the height is applied on the air in the second region R2. In other words, the pressure of the air in the second region R2 is higher than that of the air in the first region R1 by Ph. In this state, the reason why air movement between the first and the second regions is not generated is that ink enters the inside of the upper section of the filter 23 which contacts the air in the first and second area R1 and R2 by the capillary forces of the filter 23, and the meniscus of ink is formed. In other words, as a meniscus pressure Pm is applied by the meniscus on the side of the side of the second region R2, and Ph=Pm is obtained, the air in the first and second regions R1 and R2 is in a stationary state.

Figure 3B:
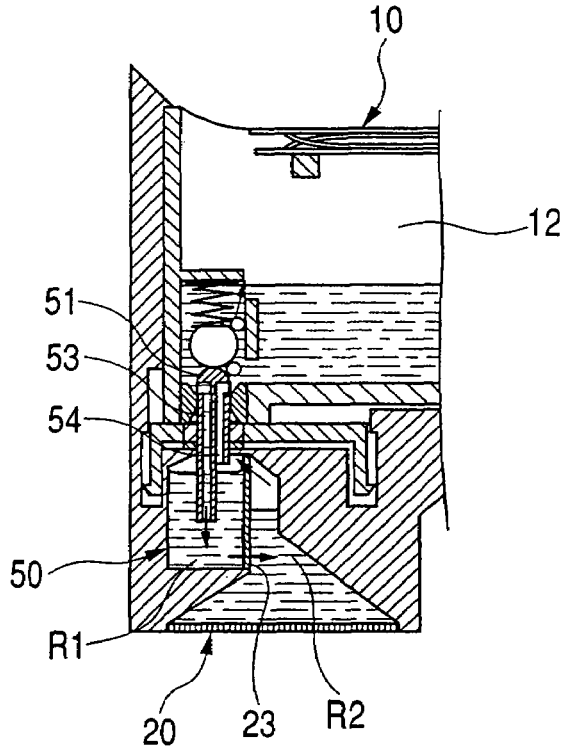
Figure 3C:
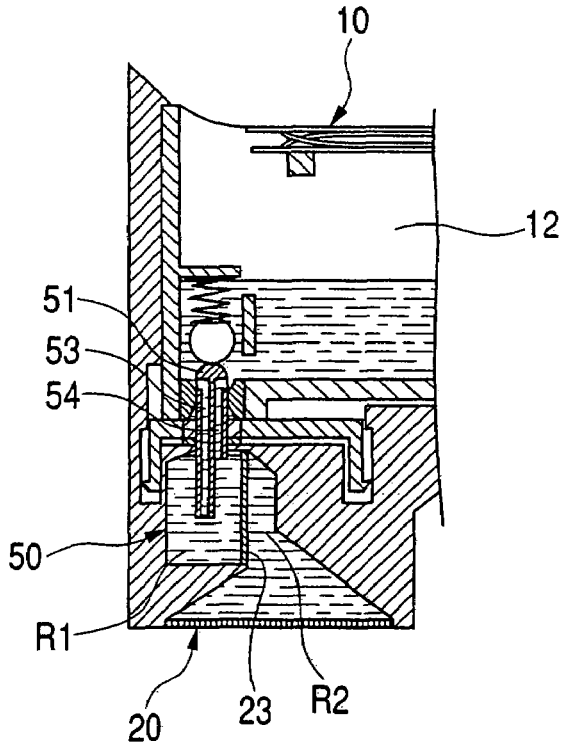

FIG. 3B is a view showing a state in which the quantity of air remaining in the second region R2 is further increased from the state shown in FIG. 3A, and, finally, air starts to move into the first region R1. The conditions on which such a movement of air is caused will be explained. When the remaining quantity of the air in the second region R2 is increased from the state shown in FIG. 3A, the level of the gas-liquid interface in the second region R2 is lowered to increase the pressure Ph, and the contact angle of the meniscus formed in the upper portion of the filter 23 becomes small. Consequently, although the meniscus pressure Pm is increased in order to secure that the pressure Pm and the pressure Ph are in balance, the contact angle exceeds a minimum contact angle to start movement of the meniscus to the side of the first region R1 because there exists the minimum contact angle for contact angles between the inside of the filter 23 and ink. Following the above, the air in the second area R2 is moved into the first region R1. When air begins to move once, no meniscus can be formed inside the filter 23 by the existence of the air movement, and air movement is processed until the position of the gas-liquid interface in the first region R1 becomes equal to that of the gas-liquid interface in the second region R2. However, as the air in the first region R1 is exhausted to the side of the ink tank 10 when the quantity of air exceeds a predetermined quantity as explained in FIG. 2A through 2D, the air remaining in the second region R2 is finally exhausted to the ink tank 10 through the first region R1. FIG. 3C is a view showing a state in which the air exhaust is completed.

In this configuration, as the upper portion of the filter 23 contacting the air remaining in the second region R2 does not contribute to the ink movement in the state as shown in FIG. 3A, the area of the filter has been substantially reduced. Therefore, even if air remains in the second region. R2 and the area of the filter is substantially reduced to reach a head pressure difference h by which air movement is started as shown in FIG. 3B, the area of the filter is required to be designed so that ink is fully supplied through the filter 23.

Second Embodiment

Figure 4:
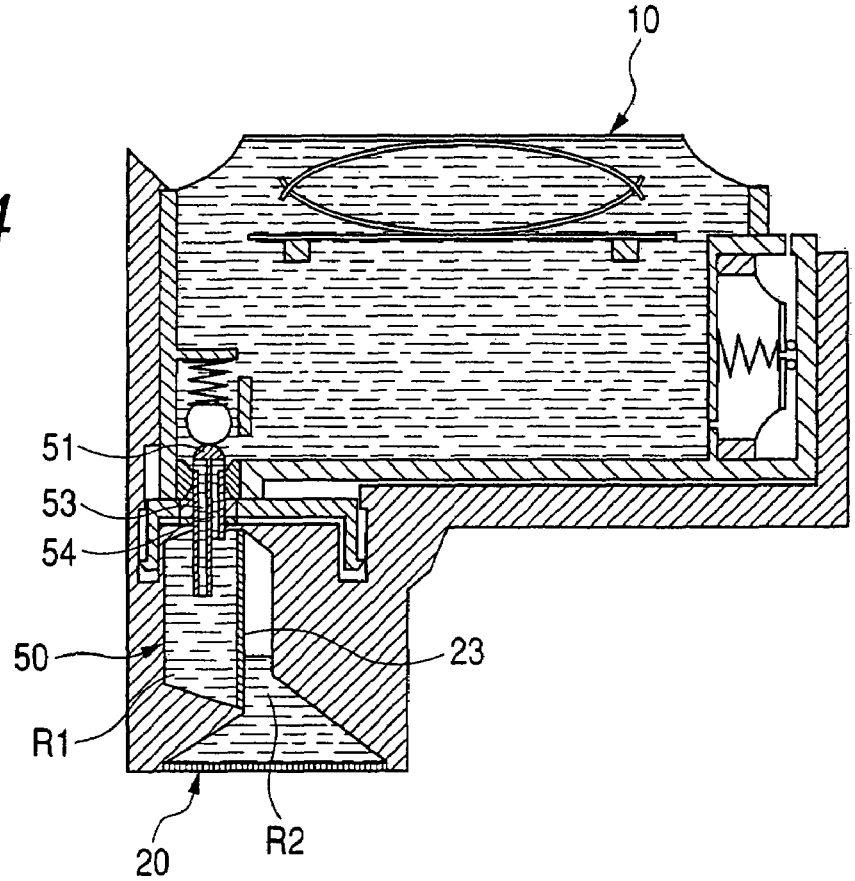
FIG. 4 is an exemplary sectional view of an ink supply system according to a second embodiment of the present invention.

FIG. 4 is ah exemplary sectional view of an ink supply system which explains a second embodiment according to the present invention.

The difference between the above-described first embodiment and the present one is that the head side opening position in the air flow path 54 is equal to that of the upper inner wall surface in the liquid chamber 50, all the air remaining in the first region R1 is exhausted when the air in the first region R1 is exhausted into the ink tank 10, and there is no air remaining in the first region R1. In this case, when the quantity of the air remaining in the second region R2 exceeds a predetermined quantity, the air is moved into the first region R1, and the quantity of the air in the second region R2 is kept within the predetermined quantity. However, as the first region R1 is filled only with ink even when air movement is generated, a meniscus is quickly formed in the filter 23 and the air movement is stopped. Accordingly, the quantity of the air remaining in the second region R2 is kept within almost a predetermined quantity at starting the air movement. As the predetermined quantity is decided by the head pressure difference of ink, the quantity of air at starting the air movement is reduced by a configuration in which the upper portion of the second region R2 is made narrower as shown in FIG. 4, and the quantity of the air remaining in the second region R2 can be reduced.

Third Embodiment

Figure 5:
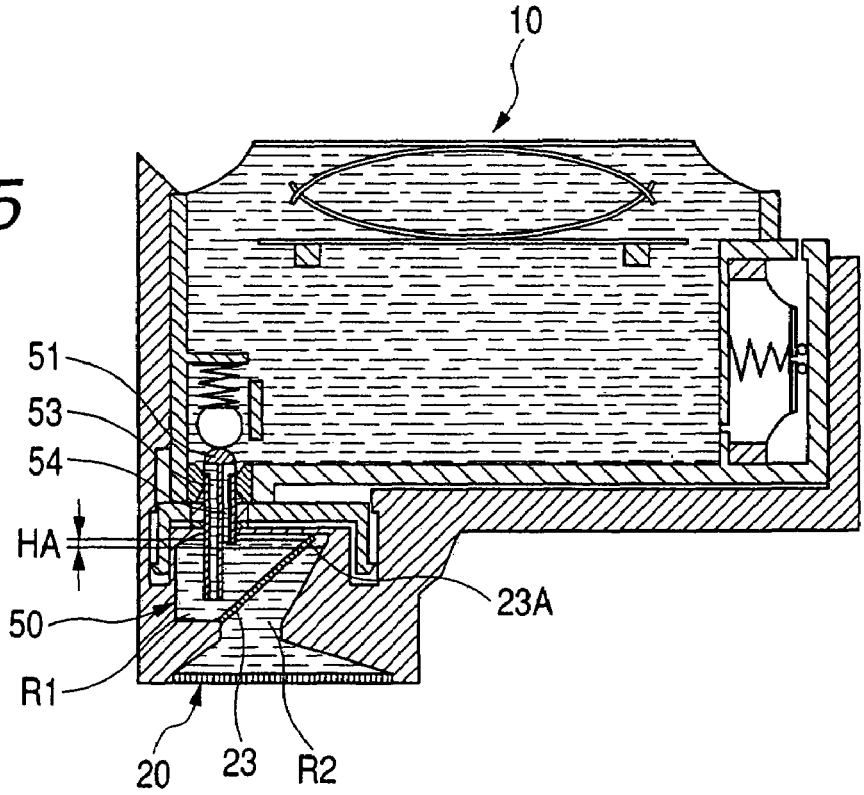
FIG. 5 is an exemplary sectional view of an ink supply system according to a third embodiment of the present invention.

FIG. 5 is an exemplary sectional view of an ink supply system which explains a third embodiment according to the present invention.

In the present example, the upper portion of a filter 23 is subjected to water repelling processing, for example, by which a water repelling material is painted on the portion, and the painted portion is called a portion 23A. The contact angle with ink at the portion 23A in which the water repelling processing is performed is increased, and a meniscus pressure Pm (Refer to FIG. 3A) at the portion 23A is reduced. Therefore, the quantity of the air remaining in a second region R2 is reduced, and the air movement is started even when the difference HA between the gas-liquid interface of a first region R1 and that of the second region R2 is small. Accordingly, air can be exhausted even when the filter 23 is arranged at an angle with respect to the horizontal direction as shown in FIG. 5. As a result, the space efficiency in a recording head 20 can be improved. Furthermore, as a high degree of flexibility in disposing the filter 23 is secured, advantages will be obtained for designing and manufacturing the recording head 20.

Fourth Embodiment

Figure 6:
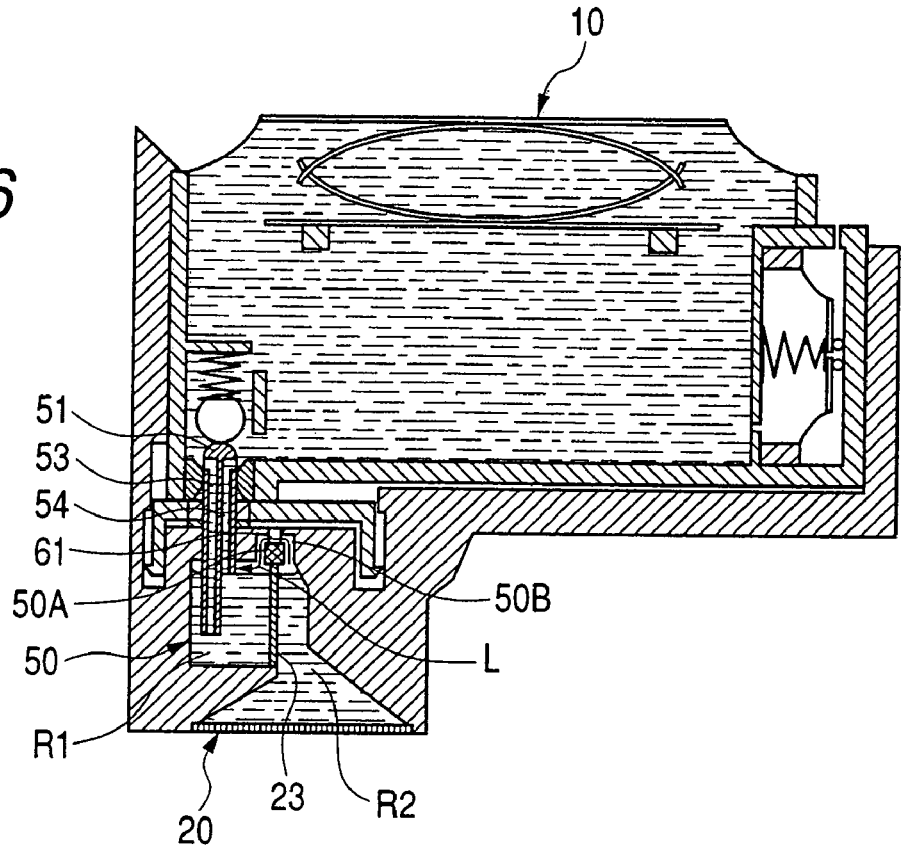
FIG. 6 is an exemplary sectional view of an ink supply system according to a fourth embodiment of the present invention.

FIG. 6 is an exemplary sectional view of an ink supply system which explains a fourth embodiment according to the present invention.

The present example has a configuration in which the upper portion of a first region R1 and that of a second region R2 are communicated with each other through an air exhaust flow path L. Specifically, a filter 23 which partitions into the first region R1 and the second region R2 is provided in the lower side of an intermediate wall section 50A in a liquid chamber 50. The first region R1 and the second region R2 are communicated with each other through a communication section 50B which is provided in the upper side of the intermediate wall section 50A, and the air exhaust flow path L is formed with the communication section 50B. In the present example, as a meniscus pressure of a meniscus formed in the air exhaust flow path L becomes very small and negligible when the flow path diameter of the air exhaust flow path L is made fully large, the positions of the gas-liquid interface in the first region R1 and that of the second region R2 becomes approximately constant at any times. Therefore, when the air generated in the second region R2 is moved to the upper portion, the air can be quickly moved into the first region R1 through the air exhaust flow path L.

However, when ink can be moved from the first region R1 to the second region R2 through the air exhaust flow path L, there is a possibility that the function of the filter 23 removing foreign substances is degraded. Thereby, it is preferable in such a case that the air exhaust flow path L is partitioned with a water repelling film 61 which blocks ink movement, and allows air movement.

Fifth Embodiment

Figure 7:
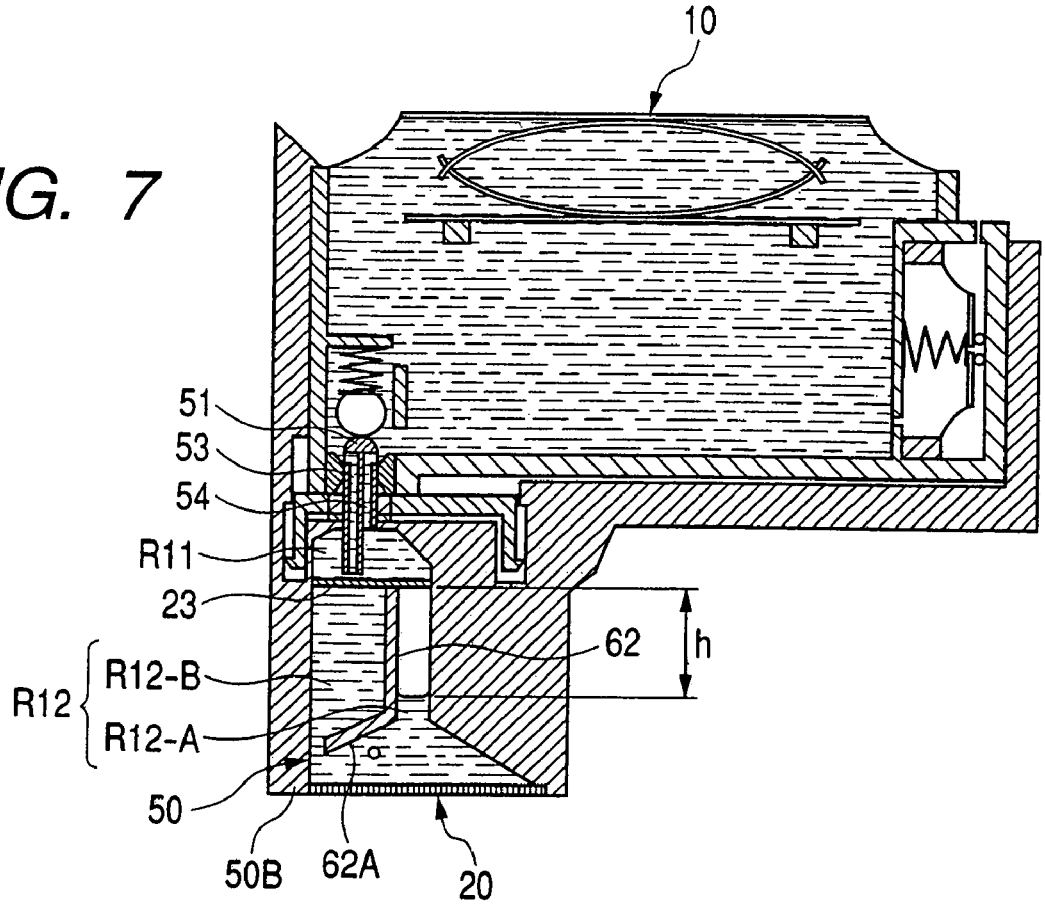
FIG. 7 is an exemplary sectional view of an ink supply system according to a fifth embodiment of the present invention.

FIG. 7 is an exemplary sectional view of an ink supply system which explains a fifth embodiment according to the present invention.

In the present example, the inside of a liquid chamber 50 is partitioned into upper and lower portions, that is, into a first region R11 and a second region R12 with a filter 23. Moreover, the upper portion of the second region R12 is partitioned into an air holding region R12-A and an ink slow path region R12-B with a partition member 62 located in the lower side of the filter 23. A guide section 62A, which guides bubbles so that bubbles generated in a recording head 20 gather in the air holding region R12-A, is formed in a lower portion of the partition material 62. It is preferable in a wall section 50B at the side of the ink flow path region R12-B that the thickness is increased, or the section 50B is formed with another member in order to reduce the permeability of air. Moreover, it is preferable for smooth ink supply that the ink flow path region 12-B is located just under the head side opening of an ink flow path 54. Furthermore, it is preferable that the horizontal cross-sectional area of the air holding region R12-A is reduced so that a height h (distance between the filter 23 and the gas-liquid interface in the air holding region R12-A) is fully large by small air volume.

In the present configuration, when the quantity of the air remaining in the air holding region R12-A is increased and the height h becomes large, a meniscus of ink at a portion of the filter 23 located at the upper portion of the air holding region R12-A is broken by the head pressure difference corresponding to the height h, and the bubble in the air holding region R12-A are moved into the first region R11. It is preferable that the portion of the filter 23 located upward over the air holding region R12-A is subjected to water repelling processing in order to reduce a meniscus force. Even when air movement from the air holding region R12-A to the first region R11 is started, a meniscus is quickly formed in the filter 23 to stop the air movement. In other words, air is moved When the height h exceeds a predetermined value, and the air movement is stopped when the height h becomes equal to or below a predetermined value. Accordingly, a predetermined quantity of air is remaining in the air holding region R12-A at any times.

Other Embodiments

The present invention may have a configuration in which a filter provided in a liquid chamber which forms an ink flow path of a sealed system partitions the liquid chamber into a first region at the side of an ink tank and a second region at the side of a recording head, and the gas in the second region is exhausted into the first region through the filter. Various kinds of forms, other than the above-described forms in which the filter is extending in the vertical, diagonal, or horizontal direction, can be applied for the disposition form of the filter. For example, there may be a configuration in which a filter extending in the horizontal direction is partially expanded upward, and air is held in the expanded internal space. In short, the filter is required only to include an ink movement portion in which the ink mainly in the first ink region is passed to the second ink region, and a gas movement portion in which by breaking a meniscus of ink, the gas mainly in the second region is moved to the first region. In the first through fourth embodiments, the ink movement portion of the filter is located upward in the gravity direction, and the gas movement section is located downward in the gravity direction. In the above-described fifth embodiment, the ink movement portion and the gas movement portion of the filter are located so that they are arranged in the horizontal direction.

Moreover, in order to make the meniscus pressure of ink formed in the gas movement portion in the filter lower than those of other portions, for example, the density of the filter in the gas movement portion is configured to be coarser than those of other portions, or the ink repelling property in the gas movement portion may be higher than those of other portions.

Moreover, the recording head 20 is configured to be of the above-described form in which the liquid chamber 50 and the connection section 51 are included, or another form in which the liquid chamber 50 is included, but the connection section 51 is not included may be applied. In this case, there may be applied a configuration in which the connection section 51 is provided at the side of the ink tank 10, or the connection section 51 is independently formed, separately from the ink tank 10 and the recording head 20, and the section 51 is installed so that the ink tank 10 and the recording head 20 are connected with each other through the section 51.

(Configuration Example of Ink Jet Recording Device)

Figure 8:
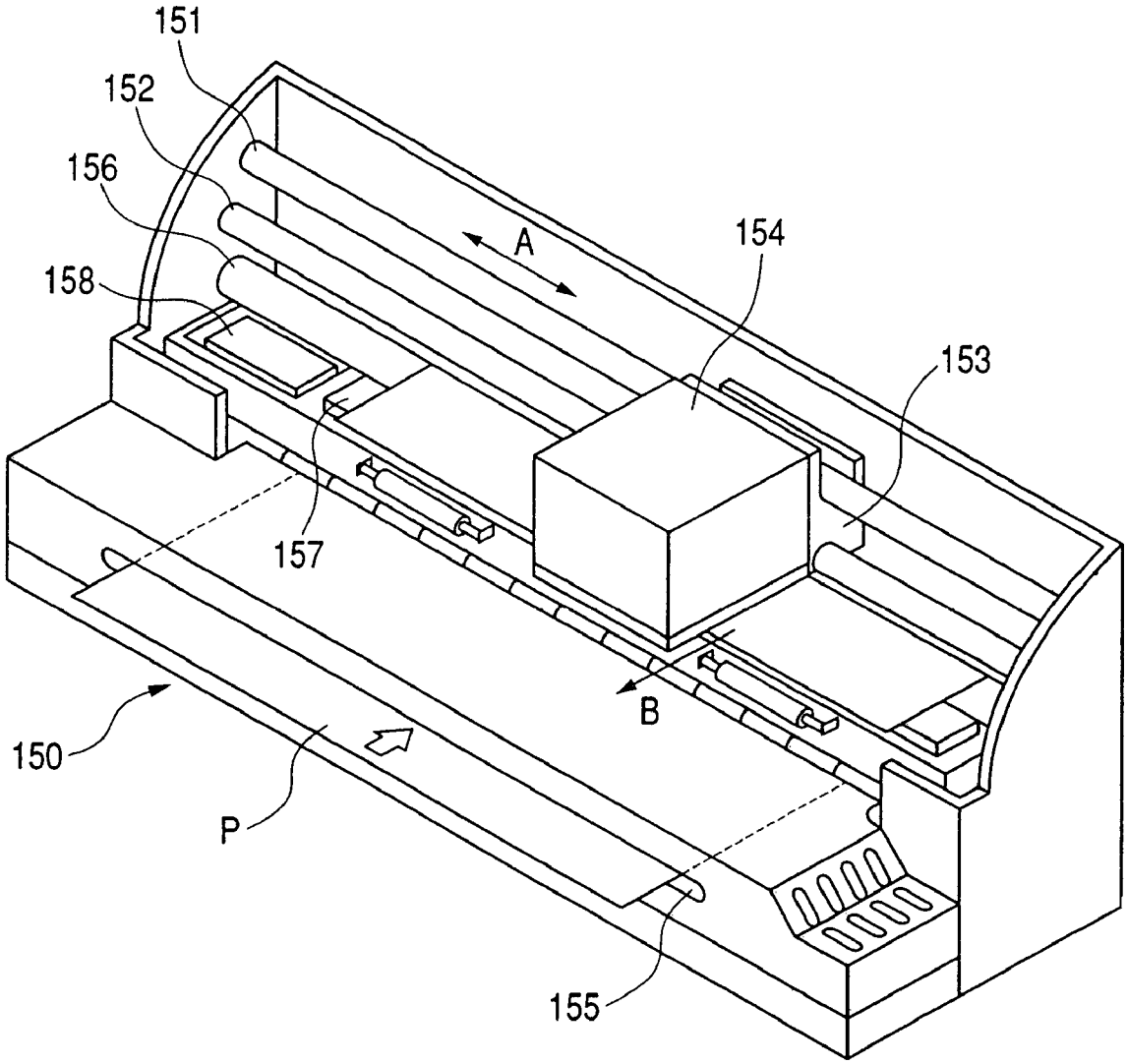
FIG. 8 is a perspective view showing a configuration example of an ink jet recording apparatus to which the present invention can be applied.
Figure 9:
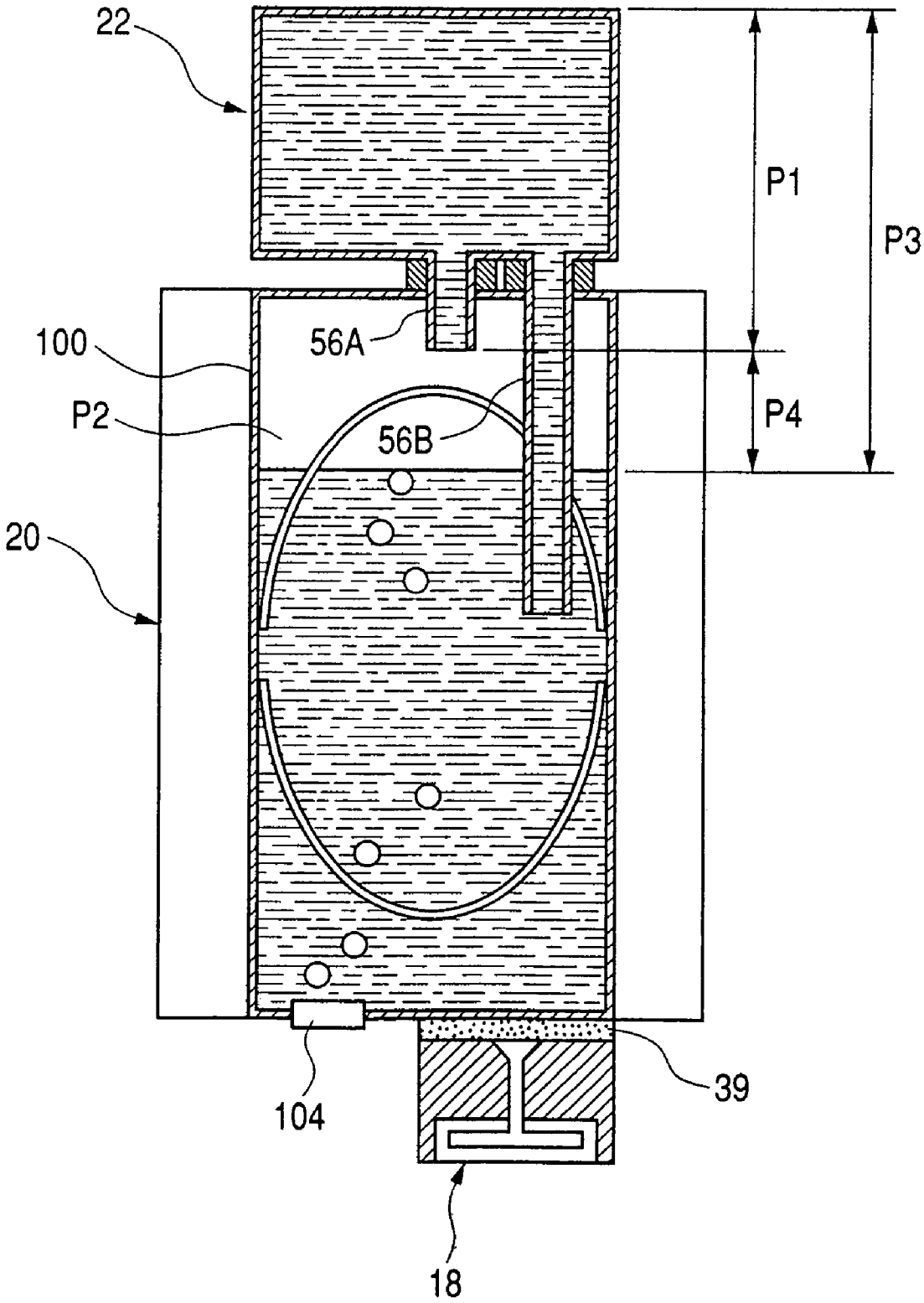
FIG. 9 is a schematic cross sectional view of a conventional example.

FIG. 8 is a view showing a configuration example of an ink jet recording apparatus to which the present invention can be applied.

A recording apparatus 150 according to the present example is an ink jet recording apparatus according to the serial recording method, wherein a carriage 153 is movably guided with guide axes 151, 152 in the main scanning direction as shown with the arrow A in the drawing. The carriage 153 is moved in a reciprocating manner in the main scanning direction by a carriage motor and a driving force transmission mechanism such as a belt which transmits the driving force of the carriage motor. The ink supply system 154 according to the above-described embodiment of the present invention can be installed in the carriage 153. That is, the ink supply system 154 comprises: a recording head like the above-described one; a liquid chamber; and an ink tank. After a sheet of paper P as a recording medium is inserted from an insertion slot 155 provided in a front section of the device, the carrying direction of the sheet is reversed, and then, the sheet is carried in the sub-scanning direction as shown with the arrow B in the drawing with a forwarding roller 156. The recording apparatus 150 sequentially records images on the sheet of paper P by repeating a recording operation, by which ink is discharged to a recording region of the sheet P on a platen 157, and a carrying operation, by which the sheet P is carried in the sub-scanning direction by a distance corresponding to the recording width, while the recording head is moved in the main scanning direction.

The recording head may use thermal energy generated from an electrical heat converter as energy by which ink is driven to be discharged, as described above. In this case, film boiling is caused in ink by heat of the electrical heat converter, and ink can be discharged from an ink discharge port by bubbling energy at that time. Moreover, an ink discharge method in the recording head is not limited to the above-described method using the electrical heat converter. For example, a method by which ink is discharge, using a piezoelectric element may be applied.

A recovery element 158 (recovery processing unit), which faces the forming surface by the ink discharge port installed on the carriage 153, has been installed in the left side of the moving region of the carriage 153 shown in FIG. 8. The recovery element 158 is provided with a cap which can cap the ink discharge port in the recording head, a suction pump by which a negative pressure can be taken into the cap, and the like. The recovery processing by which ink discharging in the recording head is kept in a preferable state can be realized by sucking and exhausting of ink from the ink discharge port after the negative pressure is taken into the cap covering the ink discharge port. Moreover, in addition to image formation, the recovery processing (also called "preliminary discharging processing"), by which ink discharging by the recording head is kept in a preferable state, can be performed by exhaling ink from the ink discharge port toward the inside of the cap. These kinds of processing can be performed when an ink tank is newly installed in the head as described above.

(Others)

In the above described ink supply systems according to various kinds of embodiments, any one of the systems have adopted a configuration in which ink is not basically maintained in an absorption body and the like, and ink is maintained as it is for storage and supplying. On the other hand, there has been applied a configuration in which a negative pressure generation unit comprises a movable member (sheet member 11 and pressure plate 14), and a spring member 40 which urges the movable member, and the inside of the ink supply system has a sealed structure as described above so that an appropriate negative pressure is applied in the recording head 20. In the above configuration, in comparison with a configuration in which the negative pressure is generated by using the ink absorption body, the volume efficiency of ink is high, consideration on the compatibility between ink and absorption bodies is not required, and the freedom degrees in selection of ink is also improved. Moreover, in addition to the above-described advantages, requirements for ink supply with a high flow rate and more reliable stability, which have been required so far along with recording at a higher speed, can be preferably met by the present invention.

Moreover, the main subject of the present invention that gas remaining in an ink supply path of a sealed system should be removed has been realized by a configuration in which the remaining gas is transferred to an ink tank at an uppermost position which is located at a remotest position from the recording head. Thereby, there has been adopted a configuration in which the ink tank and the ink supply path are connected through a plurality of flow paths and an operation by which ink is flown out from the ink tank, and another operation by which ink is taken into the ink tank are performed in a parallel manner by using the pressure balance between the both operations. According to such a configuration, a complex device is not required, and gas remaining in the ink supply path can be quickly and smoothly exhausted to the side of the ink tank, although required number of components is small and the structure is simple. Moreover, as exclusion of the remaining gas is automatically done according to pressure balance when there is only some quantity of remaining gas, the reliability of the gas exclusion is high. Moreover, as the negative pressure in the ink tank is always maintained during gas exclusion processing, an ink leakage, for example, from the ink discharge ports of the ink jet recording head can surely be prevented. In addition, the ink consumption can be greatly decreased by sucking ink from the side of the discharge port of the recording head in order to exclude gas to the side of the ink tank, in comparison with a method exhausting gas from the discharge port. Furthermore, ink waste is controlled to contribute also to reduction in the running cost.

Moreover, when an ink tank with a configuration in which the tank is removably installed in the ink supply path is adopted, there has been conventionally applied a configuration in which in may cases, in order to prevent gas from entering into the side of the ink supply path at exchange operation of an ink tank, an ink tank is exchanged in a state in which the ink supply path is filled with ink, that is, before ink in the ink supply path is completely consumed. However, according to the configuration of the present invention, gas can be easily removed from a new ink tank at installing the new ink tank even if gas enters into the ink supply path at the exchange operation of an ink tank. Therefore, an ink tank can be exchanged after the ink is completely consumed. Thereby, not only further reduction in the running cost can be realized, but also remarkable contribution to environmental problems may be achieved. In addition, any of the above-described embodiments have adopted a configuration in which the ink tank is arranged at the uppermost position in a posture at usual use, and the liquid chamber or the recording head is arranged in a lower position. This is a very preferable arrangement for quick and smooth gas-liquid exchange with a simple configuration.

Here, if the gas taken into the ink tank does not return to the ink supply path, and the ink supply is not blocked with the gas, the gas may be remaining in any place in the ink tank. However, it is not preferable that ink is not soaked in a absorption body and the like and is remaining as it is therein like the above-described embodiments, because the gas taken into the ink tank is located at the uppermost position in the ink tank as it is. Thus, when there is no absorption body for ink in the ink tank, the size of the ink tank is not required to be larger than a necessary one, and the shape of the ink tank can be designed comparatively freely.

Moreover, although the above-described embodiments have been application examples of a serial-type ink jet recording apparatus, the present invention is not limited to the above examples, but can be various kinds of recording methods. For example, the present invention can be applied not only to a serial type recording apparatus, but also to a path scanning type one. In addition, it is obvious that a plurality of ink supply systems can be provided in order to meet various kinds of tones (colors, densities, and the like) of ink.

Moreover, the present invention can be widely applied to a system by which liquid (medical fluid, beverages, and the like) other than ink is supplied.

This application claims priority from Japanese Patent Application No. 2003-338726 filed on Sep. 29, 2003, which is hereby incorporated by reference herein.

What is claimed is:

1. An ink supply system comprising:

an ink tank which contains ink, and a liquid chamber which is connected to the ink tank through a plurality of communication paths, and which supplies ink taken from the ink tank to a recording head, wherein the liquid chamber, except the plurality of communication paths and a connection section to the recording head, forms a substantially sealed space;

wherein the liquid chamber is provided with a filter which partitions the inside of the liquid chamber into a first region at the side of the ink tank and a second region at the side of the recording head, and which forms a meniscus of ink which is broken by a pressure of gas in the second region; and wherein the filter includes an ink movement section through which the ink mainly in the first ink region is transferred to the second ink region, and a gas movement section in which the gas mainly in the second region is moved to the first region by movement of a meniscus of ink from the second region to the first region.

2. The ink supply system according to claim 1, comprising a unit by which the atmosphere is taken into the ink tank not through the liquid chamber, wherein the unit is provided in the ink tank.

3. The ink supply system according to claim 1, wherein with regard to the plurality of communication paths, the positions of opening sections thereof at the side of the liquid chamber are different from each other in the vertical direction.

4. The ink supply system according to claim 1, wherein the ink in the ink tank is taken into the liquid chamber through at least one of the plurality of communication paths, and the gas in the liquid chamber is transferred to the ink tank through at least another one.

5. The ink supply system according to claim 1, wherein a lower portion in the gravity direction forming the ink movement section, and an upper portion in the gravity direction forming the gas movement section, are formed in the filter.

6. The ink supply system according to claim 5, wherein with regard to the filter, the meniscus pressure of the ink formed in the gas movement portion is smaller than that of other portions.

7. The ink supply system according to claim 6, wherein with regard to the filter, the density of the filter in the gas movement portion is coarser than that of other portions.

8. The ink supply system according to claim 1, wherein with regard to the filter, an ink repelling property thereof in the gas movement portion is higher than that of other portions.

9. The ink supply system according to claim 1, wherein the liquid chamber is provided with a gas exhaust path through which an upper portion of the second region in the gravity direction, and an upper portion of the first region in the gravity direction, are communicated with each other.

10. The ink supply system according to claim 1, wherein the ink tank and the liquid chamber can be separated from each other.

11. A recording apparatus which records, using a recording head into which ink is supplied from an ink tank, wherein the recording apparatus is provided with an ink supply system according to claim 1 in order to supply ink to the recording head.

12. A recording head into which ink is supplied from an ink tank, comprising:

a liquid chamber which is connected to the ink tank through a plurality of communication paths, and which supplies the ink taken in from the ink tank to the recording head, wherein the liquid chamber, except the plurality of communication paths and a connection section to the recording head, forms a substantially sealed space;

wherein the liquid chamber is provided with a filter which partitions the inside of the liquid chamber into a first region at the side of the ink tank and a second region at the side of the recording head, and which forms a meniscus of ink which is broken by a pressure of gas in the second region; and wherein the filter includes an ink movement section through which the ink mainly in the first ink region is transferred to the second ink region, and a gas movement section in which the gas mainly in the second region is moved to the first region by movement of a meniscus of ink from the second region to the first region.

* * * * *